United States Patent [19]

Lewis et al.

[11] Patent Number: 4,963,105

[45] Date of Patent: Oct. 16, 1990

[54] ELECTRICAL CONNECTOR ASSEMBLY

[75] Inventors: Christopher Lewis, Southboro; Donald G. Gartzke, Ipswich; Anthony R. Scannelli, Stoneham, all of Mass.

[73] Assignee: Dynawave Incorporated, Georgetown, Mass.

[21] Appl. No.: 318,864

[22] Filed: Mar. 3, 1989

[51] Int. Cl.[5] ..... H01R 13/00

[52] U.S. Cl. ..... 439/578

[58] Field of Search ..... 439/578–585

[56] References Cited

U.S. PATENT DOCUMENTS 3,533,047 10/1970 McFarlane ..... 439/578

3,818,421 6/1974 Kruger ..... 439/578

*Primary Examiner*—Joseph H. McGlynn

*Attorney, Agent, or Firm*—John E. Toupal; Harold G. Jarcho

[57] ABSTRACT

An electrical connector assembly including a male plug having a male inner conductor and a cylindrical male outer conductor surrounding the inner conductor and having an annular outer surface portion; a female plug having a female inner conductor and a cylindrical female outer conductor surrounding the female inner conductor and having an annular inner surface portion surrounding the outer surface portion, and an annular electrically conductive coil spring extending around the outer surface portion and engaged between the inner and outer surface portions and wherein the spring is adapted to exert therebetween forces that cause axial loading between the male and female outer conductors. In addition to locking the male plug to the female plug, the electrically conductive coil spring enhances the electrical connection between the outer conductors and improves radio frequency interference suppression.

19 Claims, 1 Drawing Sheet

ELECTRICAL CONNECTOR ASSEMBLY

BACKGROUND OF THE INVENTION

This invention relates generally to an electrical connector assembly and, more particularly, to an electrical connector assembly for connecting coaxial radio frequency transmission lines.

Plug type connector assemblies are used commonly to facilitate quick connection and disconnection of components or modules in electrical circuit systems. Such connector assemblies permit rapid access to electrical components for maintenance or repair functions. When used in certain applications such as for the transmission of rf signals, an important requirement of plug type connectors is that they exhibit a relatively low electrical signal disturbance characteristic in that signal interference or attenuation can significantly degrade the performance of an entire electrical system.

The object of this invention, therefore, is to provide for coaxial transmission lines an improved plug type connector assembly that combines a quick connect-disconnect capability with a low signal disturbance characteristic.

SUMMARY OF THE INVENTION

The invention is an electrical connector assembly including a male plug having a male inner conductor and a cylindrical male outer conductor surrounding the inner conductor and having an annular outer surface portion; a female plug having a female inner conductor and a cylindrical female outer conductor surrounding the female inner conductor and having an annular inner surface portion surrounding the outer surface portion, and an annular electrically conductive coil spring extending around the outer surface portion and engaged between the inner and outer surface portions and wherein the spring is adapted to exert therebetween forces that cause axial loading between the male and female outer conductors. In addition to locking the male plug to the female plug, the electrically conductive coil spring enhances the electrical connection between the outer conductors and improves radio frequency interference suppression.

According to certain features of the invention, the outer surface portion includes a first surface of revolution disposed at an angle to the axis of the cylindrical male outer conductor, the inner surface portion includes a second surface of revolution disposed at an angle to the axis of the cylindrical female outer conductor, the annular coil spring is a continuous ellipsoidal spring composed of elliptically shaped coils and engaged between the first and second surfaces. These structural features enhance the functional performance of the coil spring.

An important feature of the invention is the provision of a second electrically conductive coil spring extending around the outer surface portion and disposed substantially parallel to the annular coil spring. The second coil spring also is annular and engaged between the inner and outer surface portions and exerts therebetween forces that produce axial loading between the male and female outer conductors. Provision of a second coil spring significantly improves the radio frequency interference suppression characteristics of the connector assembly.

According to specific features of the invention, the inner surface portion defines first and second annular grooves retaining the coil springs and the outer surface portion defines a tapered surface portion engaging the annular coil spring and a cylindrical surface portion joined to the tapered surface portion and engaging the second coil spring. This structural arrangement provides in a highly efficient form the performance characteristics desired for the connector assembly.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
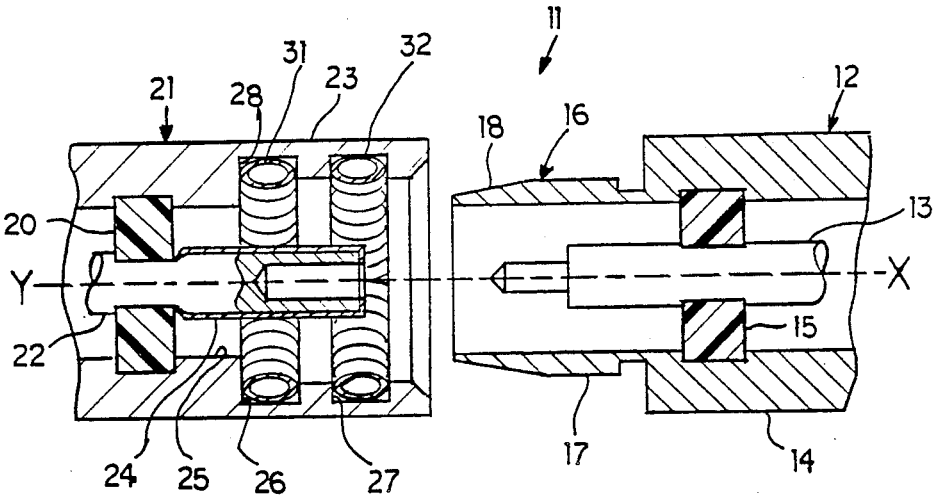
FIG. 1 is a side view in cross section of an electrical connector assembly in accordance with the present invention and illustrating a male plug member of the assembly disengaged from a female plug member thereof.
Figure 2:
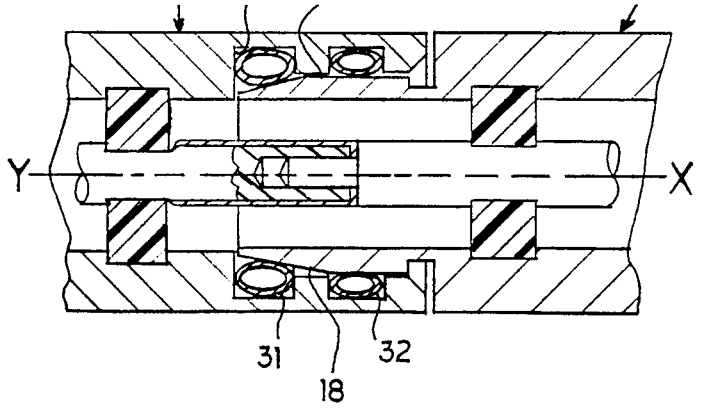
FIG. 2 is a side view in cross section of the assembly shown in FIG. 1 but with the male plug member engaged with the female plug member.

For reasons of clarity and convenience, a connector assembly 11 of the present invention is shown only partially in FIGS. 1 and 2. It will be understood that the missing portions of the electrical conductors shown are conventional and adapted for connection in a normal manner to specific parts of a complete electrical system. A male plug 12 includes an electrically conductive male inner conductor pin member 13 (male) of circular cross section and adapted for electrical connection to an inner conductor of a coaxial circuit (not shown). Surrounding the inner conductor pin member 13 is an electrically conductive, cylindrical male outer conductor member 14 adapted for electrical connection in a conventional manner to an outer conductive shield of the coaxial circuit. The inner conductor pin member 13 and the outer conductor member 14 are electrically isolated from one another by an annular spacer 15 formed of a suitable electrical insulation material. Defined at one end of the outer conductor member 14 is an annular outer surface portion 16 formed by a cylindrical surface portion 17 and an adjoining, inwardly tapered surface portion 18 that terminates the male plug 12. The tapered surface of revolution 18 is disposed at an angle with the longitudinal axis X of the male plug 12.

A female plug member 21 includes an electrically conductive, female inner conductor pin member 22 also adapted for connection to an inner conductor of a coaxial circuit (not shown). Surrounding the inner conductor pin member 22 is a cylindrical female outer conductor member 23 similarly adapted for connection to an outer conductive shield of the coaxial circuit. The inner conductor member 22 is electrically isolated from the outer conductor member 23 by an annular spacer 20 formed of s suitable electrical insulation material. An electrically conductive hood member 24 is closely fitted over an end of the inner conductor pin member 22. Formed at one end of the outer conductor member 23 is an annular inner surface portion 25 that defines first and second, parallel annular grooves 26, 27. An inner sidewall portion 28 of the first annular groove 26 forms a second surface of revolution disposed at an angle with the longitudinal axis Y of the female plug member 21.

A first electrically conductive annular coil spring 31 is retained by the first groove 26 in the inner surface portion 25 of the outer conductor member 23. Similarly retained by the second groove 27 therein is a second, electrically conductive annular coil spring 32. Upon insertion of the male plug 12 into the female plug 21 as shown in FIG. 2, the coil springs 31 and 32 surround the outer surface portion 16 and are engaged between the inner surface portion 25 and the outer surface portion 16. The first coil spring 31 exerts between the male plug 12 and the female plug 21 forces that cause axial loading therebetween. For that reason, a desirable high insertion force is required to engage the male plug 12 with the female plug 21. Each of the first and second coil springs 31 and 32 maintains continuous electrical contact between the male outer conductor 14 and the female outer conductor 23 even under conditions of a slight misalignment or incomplete seating between the male plug 12 and the female plug 21. Consequently, the coil springs 31, 32 significantly enhance the radio frequency interference suppression characteristics of the connector assembly 11 by significantly reducing rf signal leakage through the annular gap 35 between the male plug 12 and the female plug 21.

Preferably, each of the coil springs 31, 32 is an continuous ellipsoidal spring including a plurality of elliptically shaped coils disposed in a canted relationship with an annular axis of the spring. A detailed description of a preferred ellipsoidal spring appears in U.S. Pat. Nos. 4,655,462 and 4,678,210 which are incorporated herewith by specific reference thereto. Because of the axial loading provided by the spring members 31, 32, a highly stable connection is created between the male plug member 12 and the female plug member 21.

Obviously, many modifications and variations of the present invention are possible in light of the above teachings. It is to be understood, therefore, that the invention can be practiced otherwise than as specifically described.

What is claimed is:

1. An electrical connector assembly comprising:

male plug means comprising a male inner conductor, a cylindrical male outer conductor surrounding said male inner conductor and having an annular outer surface portion, and electrical insulation means separating said male inner conductor from said male outer conductor;

female plug means comprising a female inner conductor, a cylindrical female outer conductor surrounding said female inner conductor and having an annular inner surface portion surrounding said annular outer surface portion and electrical insulation means separating said female inner conductor from said female outer conductor; and an annular electrically conductive coil spring extending around said outer surface portion and engaged between said inner and outer surface portions, said spring adapted to exert therebetween forces that produce axial loading between said male and female outer conductors.

2. An electrical connector assembly according to claim 1 wherein said annular coil spring is a continuous ellipsoidal spring.

3. An electrical connector assembly according to claim 2 wherein said continuous ellipsoidal spring comprises a plurality of elliptically shaped coils.

4. An electrical connector assembly according to claim 3 wherein one of said inner and outer surface portions defines an annular groove retaining said annular coil spring, and the other of said inner and outer surface portion defines a tapered surface portion engaging said annular coil spring.

5. An electrical connector assembly according to claim 1 wherein said outer surface portion comprises a first surface of revolution disposed at an angle to the axis of said cylindrical male outer conductor, said inner surface portion comprises a second surface of revolution disposed at an angle to the axis of said cylindrical female outer conductor, and wherein said annular coil spring is engaged between said first and second surfaces.

6. An electrical connector assembly according to claim 5 wherein said annular coil spring is a continuous ellipsoidal spring.

7. An electrical connector assembly according to claim 6 wherein said continuous ellipsoidal spring comprises a plurality of elliptlcally shaped coils.

8. An electrical connector assembly according to claim 7 wherein one of said inner and outer surface portions defines an annular groove retaining said annular coil spring, and the other of said inner and outer surface portion defines a tapered surface portion engaging said annular coil spring.

9. An electrical connector assembly according to claim 1 and including a second electrically conductive coil spring extending around said outer surface portion and disposed substantially parallel to said annular coil spring, and wherein said second coil spring is annular and engaged between said inner and outer surface portions and exerts therebetween forces that produce axial loading between said male and female outer conductors.

10. An electrical connector assembly according to claim 9 wherein each of said annular and second coil springs is a continuous ellipsoidal spring.

11. An electrical connector assembly according to claim 10 wherein said outer surface portion comprises a first surface of revolution disposed at an angle to the axis of said cylindrical male outer conductor, said inner surface portion comprises a second surface of revolution disposed at an angle to the axis of said cylindrical female outer conductor, and wherein said annular coil spring is engaged between said first and second surfaces.

12. An electrical connector assembly according to claim 11 wherein one of said inner and outer surface portions defines an annular groove retaining said annular coil spring, and the other of said inner and outer surface portion defines a tapered surface portion engaging said annular coil spring.

13. An electrical connector assembly according to claim 12 wherein one of said inner and outer surface portions defines a second groove retaining said second coil spring.

14. An electrical connector assembly according to claim 13 wherein said one surface portion is said inner surface portion.

15. An electrical connector assembly according to claim 9 wherein one of said inner and outer surface portions defines an annular groove retaining said annular coil spring, and the other of said inner and outer surface portion defines a tapered surface portion engaging said annular coil spring.

16. An electrical connector assembly according to claim 15 wherein said one surface portion is said inner surface portion.

17. An electrical connector assembly according to claim 1 wherein one of said inner and outer surface portions defines an annular groove retaining said annular coil spring, and the other of said inner and outer surface portion defines a tapered surface portion engaging said annular coil spring.

18. An electrical connector assembly according to claim 17 wherein said one surface portion is said inner surface portion.

19. An electrical connector assembly according to claim 18 wherein said outer surface portion further defines a cylindrical surface portion joined to said tapered surface portion and engaging said second coil spring.

* * * * *